US010471448B2

(12) United States Patent
Markus

(10) Patent No.: US 10,471,448 B2
(45) Date of Patent: Nov. 12, 2019

(54) PNEUMATIC ATOMIZING NOZZLE

(71) Applicant: SPRAYING SYSTEMS MANUFACTURING EUROPE GMBH, Schorndorf (DE)

(72) Inventor: Stefan Markus, Stuttgard (DE)

(73) Assignee: Spraying Systems Manufacturing Europe GmbH, Schorndorf (DE)

( * ) Notice: Subject to any disclaimer, the term of this patent is extended or adjusted under 35 U.S.C. 154(b) by 271 days.

(21) Appl. No.: 15/517,754

(22) PCT Filed: Oct. 9, 2014

(86) PCT No.: PCT/EP2014/071692
§ 371 (c)(1),
(2) Date: Apr. 7, 2017

(87) PCT Pub. No.: WO2016/055116
PCT Pub. Date: Apr. 14, 2016

(65) Prior Publication Data
US 2017/0304850 A1 Oct. 26, 2017

(51) Int. Cl.
*B05B 7/04* (2006.01)
*B05B 7/10* (2006.01)
(Continued)

(52) U.S. Cl.
CPC ..... *B05B 7/0483* (2013.01); *B05B 7/0081* (2013.01); *B05B 7/025* (2013.01);
(Continued)

(58) Field of Classification Search
CPC ..... B05B 7/0081; B05B 7/025; B05B 7/045; B05B 7/0483; B05B 7/0807; B05B 7/0815; B05B 7/0892; B05B 7/10
See application file for complete search history.

(56) References Cited

U.S. PATENT DOCUMENTS 4,063,686 A * 12/1977 Willis ..... B05B 1/265 239/404
5,553,785 A * 9/1996 Haruch ..... B05B 1/3436 239/432
(Continued)

FOREIGN PATENT DOCUMENTS

CN 1012-32948 A 7/2008
CN 1017-55070 A 6/2010
(Continued)

OTHER PUBLICATIONS

European Patent Office, International Search Report in International Application No. PCT/EP2014/071692 (dated Jun. 18, 2015).

*Primary Examiner* — Ryan A Reis
(74) *Attorney, Agent, or Firm* — Leydig, Voit & Mayer, Ltd.

(57) ABSTRACT

A pneumatic atomizing nozzle (10) which in a preferred form can be supplied with gas by means of a fan (43). The pneumatic atomizing nozzle (10) has a nozzle body (11), which bounds a flow space (21). The pneumatic atomizing nozzle (10) also has a liquid channel (27) having an outlet opening (38). Within the flow space (21), a liquid film (41) is formed, which is transported within the flow space (21) to a nozzle outlet (17) by the gas flow. The outlet opening (38) of the liquid channel (27) defines an outlet direction (A) for the liquid into the flow space (21), which in the preferred embodiment is opposite the flow direction (S) of the liquid film (41). At least in some sections, the liquid channel (27) and the outlet opening (38) extend transversely through the nozzle body (11) in a curved, wound, or meandering manner.

17 Claims, 6 Drawing Sheets

Figure 1:
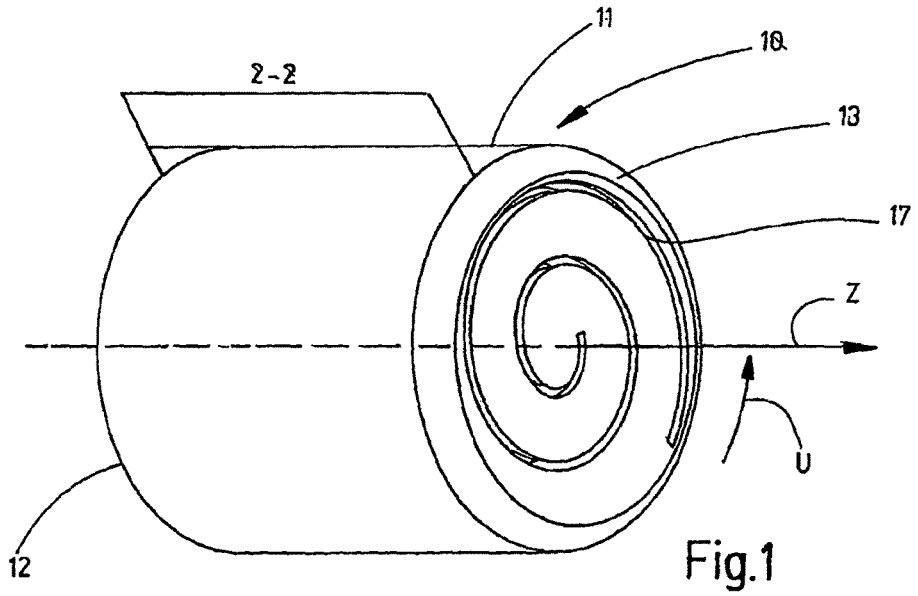

(51) Int. Cl.

| | |
|---|---|
| ***B05B 7/00*** | (2006.01) |
| ***B05B 7/02*** | (2006.01) |
| *B01F 3/04* | (2006.01) |

(52) U.S. Cl.
CPC ..... *B05B 7/045* (2013.01); *B05B 7/10* (2013.01); *B01F 3/04* (2013.01)

(56) References Cited

U.S. PATENT DOCUMENTS

| | | | | |
|---|---|---|---|---|
| 8,028,934 | B2 * | 10/2011 | Wurz | B05B 7/0458 239/419 |
| 2010/0276517 | A1 | 11/2010 | Alansary | |

FOREIGN PATENT DOCUMENTS

| | | | | | |
|---|---|---|---|---|---|
| CN | 1025-74140 | A | | 7/2012 | |
| CN | 1025-80874 | A | | 7/2012 | |
| DE | 3144562 | A1 | | 5/1983 | |
| DE | 4128670 | A1 | | 3/1993 | |
| FR | 1008377 | A | | 5/1952 | |
| GB | 958100 | A | * | 5/1964 | B05B 1/265 |
| JP | S47-018 585 | A | | 9/1972 | |
| JP | S47-033 653 | A | | 11/1972 | |
| JP | H08-502 203 | A | | 3/1996 | |
| JP | 2004-237282 | A | | 8/2004 | |
| JP | 2014/083744 | A | | 5/2014 | |
| JP | 2014/136311 | A | | 7/2014 | |
| WO | WO 94/08724 | A1 | | 4/1994 | |
| WO | WO-9408724 | A1 | * | 4/1994 | B05B 7/0466 |
| WO | WO 2006/108740 | A1 | | 10/2006 | |

* cited by examiner

PNEUMATIC ATOMIZING NOZZLE

The invention relates to a pneumatic atomizing nozzle, a nozzle device and a method for operating a pneumatic atomizing nozzle.

Pneumatic atomizing nozzles are used in applications in which finely atomized liquid droplets are required, including, for example in systems for dust precipitation or gas cooling systems. A liquid or a liquid mixture or a suspension, which may also contain additives such as cleaning agents or the like, is supplied to a pneumatic atomizing nozzle. Hereinafter reference is made to a liquid which shall also comprise mixtures of liquids. In order to atomize the liquid into fine liquid droplets a pressurized gas flows with the liquid out of a chamber, thus supporting atomization. The liquid that is atomized with the pressurized air is dispensed as an atomized spray jet from at least one outlet opening of the pneumatic atomizing nozzle.

A pneumatic atomizing nozzle has been known from publication EP 0 714 706 B1, for example. The pneumatic atomizing nozzle comprises a liquid connection, as well as an air connection. The liquid connection is fluidically connected to a liquid channel that extends coaxially along a nozzle axis and terminates in a mixing chamber. The liquid flow flows in the form of a jet along the nozzle axis into the mixing chamber. Radially with respect to the nozzle axis, several injection channels discharge into the mixing chamber, said channels being fluidically connected to the air connection. In the mixing chamber, the axial liquid flow is atomized by means of the inflowing air and is dispensed downstream along the nozzle axis through an outlet opening.

In most cases the nozzles are operated with water as the liquid and with pressurized air as the pressurization medium for atomization. For generating pressurized air, compressors are used which have a high purchase cost and are high-maintenance. Furthermore, compressors must be taken to the site of use or be available there, which cannot always be ensured. Due to the small dimensions of the channels in known pneumatic atomizing nozzles, they must also be supplied with water that is as free as possible of dirt particles to prevent a plugging of the nozzle.

Considering this, it is the object of the invention to provide an improved concept for a pneumatic atomizing nozzle.

In particular, it is the object of the invention to provide a pneumatic atomizing nozzle that overcomes the disadvantages of prior art and that allows a good atomization of the liquid without the aid of air—without requiring inevitable compressors—and that is preferably largely resistant to contamination.

This object is achieved with a pneumatic atomizing nozzle according to Claim 1, a pneumatic atomizing nozzle according to Claim 2, a nozzle device according to Claim 17, and a method for operating a pneumatic atomizing nozzle according to Claim 18.

According to a first aspect of the invention, a pneumatic atomizing nozzle is provided, said nozzle comprising a nozzle body that delimits the flow space. A gas channel is disposed to supply a gas, for example air, and terminates into the flow space. A liquid channel of the pneumatic atomizing nozzle is disposed to supply a liquid, for example water, and has at least one outlet opening. The liquid exits through the outlet opening into the flow space. In the flow space, the gas acts on the liquid in order to form a liquid film in the flow space. The outlet opening defines the outlet direction of the liquid out of the liquid channel into the flow space. The outlet opening is directed opposite a flow direction of the liquid film in the flow space.

Due to the relative arrangement of the outlet opening, the output liquid is acted upon by gas flow in such a manner that it is deflected and then continues to flow essentially in the opposite direction of flow. In doing so, the liquid is formed into a thin liquid film. This provides the basis for good atomization of the liquid film that is acted upon by the gas, e.g., air. In doing so, it is possible to work with reduced gas pressures so that, optionally, the use of a compressor may be dispensed with.

The flow direction of the liquid film is determined by the gas flow direction. The liquid and the gas are discharged through a nozzle opening of the pneumatic atomizing nozzle. The arrangement of a gas inlet and the nozzle opening defines the flow direction of the liquid film in the flow space toward the nozzle outlet.

According to another aspect of the invention, a pneumatic atomizing nozzle is produced that comprises a nozzle body that delimits a flow space, a gas channel and a liquid channel. The gas channel terminates in the flow space and is disposed to feed a gas into the flow space. The liquid channel has at least one outlet opening through which the liquid exits into the flow space. The gas acts on the liquid in the flow space in order to form a liquid film in the flow space. The liquid channel and the outlet opening extend in such a manner that they—projected onto a projection plane extending transversely through the flow space and perpendicularly to the outlet direction—form a line that is curved, wound or meandering in at least in some sections.

Due to the elongated extension of the liquid channel that is curved, wound or meandering at least in some sections, preferably kink-free, and the outlet opening, it is possible to provide an adequate length of the outlet opening for the liquid, said outlet opening making it possible to form an elongated, largely uniform, thin liquid film upon leaving the outlet opening. This provides the basis for good atomization of the liquid film acted upon by the gas, as well as for the fact that reduced gas pressures can be used, so that—optionally—the use of a compressor may be omitted.

In an advantageous embodiment, the liquid channels with its outlet opening extends in a nozzle body having the shape of a circular cylinder in an arcuate manner along the lateral surface wall of the cylinder at a radial distance therefrom. However, the liquid channel may also extend in a serpentine, meandering or otherwise suitable manner, with one or more windings or loops, through the nozzle body in order to form the longest possible arc length of the outlet opening or the largest possible outlet surface as defined by the outlet opening. The nozzle body may also have the form of a square or rectangular cylinder.

Furthermore, a pneumatic atomizing nozzle is disclosed that exhibits the features of the pneumatic atomizing nozzles consistent with the two described aspects.

Due to the arrangements and configurations that are disposed to deflect the liquid film and dispense the liquid film along the longest possible, narrow outlet opening transversely with respect to the gas channel, the flow space can also be utilized particularly effectively with gas that flows in under low pressure in order to form a liquid film. In particular, the liquid can also be effectively discharged from the pneumatic atomizing nozzle and atomized without the use of pressurized air in such a manner that fine liquid droplets form behind the pneumatic atomizing nozzle. In this case, pressurized air is understood to mean compressed air exhibiting an excess pressure of more than 1 bar.

The pneumatic atomizing nozzles may advantageously be developed further:

Preferably, at least in some sections, the liquid channel is arranged inside the flow space so that the liquid channel is enclosed in the flow space, at least in some sections. Preferably, the liquid channel extends through the flow space. In this manner, it is possible to discharge the liquid across a large area into the flow space and to distribute it so as to form a film.

Preferably, the liquid channel extends in an arcuate manner around the flow direction, at least in some sections. Due to the arcuate form of the liquid channel in the flow space, it is possible to create a relatively large outlet opening for the liquid, so that the liquid can be distributed on a large guide surface for the liquid film in a still compact nozzle body.

Preferably, the liquid channel extends, at least in some sections, along the periphery of the nozzle body. A flow direction through the channel is defined by the liquid channel, said flow direction preferably being oriented transversely with respect to the flow direction of the liquid film outside the channel. Consequently, it is possible to produce a long flow path of the liquid film through the nozzle body.

In a preferred embodiment, the liquid channel has the form of a spiral. Preferably, the liquid channel has the form of a spiral, in at least some sections. For example, the spiral may be—but not necessarily—an Archimedean spiral. The spiral may be one-dimensional or three-dimensional, i.e., form a screw. However, the liquid channel may also be circular, for example. The liquid channel may also comprise several concentric, circular sections, for example. The liquid channel may also be arranged—completely or in some sections—following a path with radial segments and circumferential segments, for example, meandering, serpentine, zigzagging, however preferably without kinks, etc., in the flow space in such a manner that a length of the liquid channel and the outlet opening adequate for the present purposes can be ensured.

In one embodiment of the invention, the liquid channel is formed by at least one first channel wall and one second channel wall. The first channel wall and/or the second channel wall may form a guide body with guide surfaces for the liquid film. The contour of the guide body—formed by the outside surface side of the first channel wall and/or the outside surface side of the second channel wall—is preferably configured so as to be suitable to guide the liquid dispensed in the form of a liquid film to the nozzle opening.

Due to the guide surface, the supplied amount of liquid with the supplied amount of gas can be utilized particularly effectively for forming and atomizing the liquid film. With this guide surface that is preferably formed by the outside surfaces of the first channel wall and the outside surface of the second channel wall, it is possible to provide an adequate effective length for the flowing gas on the liquid film. In this manner, it is possible to achieve an extremely fine atomization of the liquid—even at minimal gas pressure.

Inasmuch as the guide body extends along the periphery of the flow space, it is possible to produce a particularly wide and thus large-area guide surface for the liquid, despite a possible compact design of the pneumatic atomizing nozzle.

The gas flowing to the nozzle opening flows past the guide surface and drives the liquid or the liquid film through the nozzle opening. Due to the gas flowing over the liquid film, the liquid film can be excited to oscillate. In doing so, the film can be advantageously elongated and thus made thinner.

Preferably, the guide body is configured in such a manner that it can divide the liquid flow upon being discharged from the outlet opening into the flow space, so that the liquid flow flows around the guide body in the flow space preferably on two sides. Furthermore, the guide body is suitably configured so as to promote the deflection of the liquid in flow direction through the flow space counter the outlet direction, and the film formation.

The outlet opening is preferably arranged on one face side of the liquid channel or the guide body, so that the liquid—following the deflection—is essentially uniformly distributed over the channel wall surfaces that form the guide surface. By dividing the liquid flow and the bilateral flow of the liquid and the gas around the guide body, both sides of the guide body that are oriented transversely with respect to the gas flow direction and the liquid flow direction, respectively, are disposed to guide and form the liquid film. As a result of this, the surface of the liquid film and thus the effective area of the gas flow are enlarged.

The second channel wall—viewed in cross-section of the preferably cylindrical nozzle body through the center or cylinder axis—is preferably laterally reversed with respect to the first channel wall, in which case the plane of mirror symmetry extends parallel to the center or the cylinder axis. Preferably, the guide body is symmetrical in cross-section with respect to an axis that extends through the imaginary connecting line from the outlet opening of the liquid channel to the nozzle opening of the nozzle body.

Preferably, the guide body has a preferably symmetrical wedge form in the direction to a face side facing away from the outlet opening of the liquid channel. Particularly preferably, the guide body has the form of a bearing surface in cross-section. The guide body may also have an elongated drop shape in cross-section. These forms are particularly suitable for the deflection of the liquid after being discharged from the outlet opening and for the formation and guidance of the thin liquid film. The face side of the guide body facing the nozzle opening preferably forms a tearing edge for the liquid film, said tearing edge being located near the nozzle opening. Due to the tearing edge, the liquid can be separated from the guide surface and carried toward the outside through the nozzle opening out of the nozzle body and be atomized due to the gas flow.

In a preferred embodiment of the invention the outlet opening of the liquid channel is preferably configured so as to be continuous. This allows an unimpaired discharge of the liquid into the flow space and promotes the formation of an uninterrupted liquid film that is as cohesive as possible.

The outlet opening preferably has the form or the curvature of the section of the liquid channel that extends through the flow space. The outlet opening, like the liquid channel, is spiraliform, circular, meandering or configured in any other way with one or more windings or loops, for example. Preferably, the outlet opening extends along the periphery of the flow space. For example, the outlet opening may extend in an arcuate manner along and inner radial boundary surface of the flow space. For example, the flow space may be delimited by a cylindrical wall, along which the outlet opening extends in at least some sections. For example, the outlet opening may also extend in an arcuate form along the periphery of the flow space or the nozzle body on a path with decreasing diameter.

In a particularly preferred embodiment of a spiraliform outlet opening, the spiral form of the outlet opening extends along the periphery of the nozzle body, preferably over at least one revolution (by at 360°) or even over at least two revolutions. In this manner, the outlet opening may be "wound up". Preferably, this also applies to the liquid channel and to the guide surface. Due to the wound-up form of the outlet opening and of the guide surface, the liquid film can be exposed to the gas flow over the entire cross-sectional area of the nozzle body. In this manner, a long outlet opening and a large guide surface may be formed within the tightest space in a compact nozzle body. The large guide surface formed on the surface of the guide body ensures a thin water film onto which the gas flow may act over a large area. In this manner, it is possible, even at low gas pressures, for example, of a maximum of 300 mbar, to achieve a fine atomization of the liquid. Such pressures can be generated with standard ventilators or fans. The use of compressors that are expensive to purchase, operate and maintain can be avoided. This expands the field of use and the variety of locations where the pneumatic atomizing nozzle according to the invention can be employed.

The outlet opening is preferably an outlet slit or outlet gap, as a result of which the liquid is ejected almost linearly. Preferably the outlet slit is arranged on the face side of the guide surface facing the gas flow. In this manner, it is possible to generate a particularly thin, large-area, preferably cohesive, liquid film on the guide surface.

Due to the arcuate or spiraliform extension along the periphery of the flow space, it is indeed possible to attain a gap-shaped outlet opening; however—overall—there is still provided a large outlet surface through which the required amount of liquid enters into the flow space.

The free flow path through the nozzle body and out of the nozzle body has a dimension transversely with respect to the flow direction, preferably at all times, of at least 2 mm. The pneumatic atomizing nozzle made in this way is less susceptible to plugging, even if the pneumatic atomizing nozzle is charged with water loaded with dirt particles. As a result of this, the pneumatic atomizing nozzle can also be reliably used at locations where clean water for the nozzle is not available.

The flow space may comprise a section having the form of a spiral. The spiraliform section may contain the spiraliform liquid channel. The spiraliform flow space may have an open face side where the gas channel terminates in the flow space. The outlet opening of the liquid channel is preferably oriented in the same direction as the open face side of the spiraliform section of the flow space. The outlet opening may be offset relative to the face side, backward in the direction of the nozzle opening. Due to the described arrangement, the gas flow can be radially divided, in which case the flow space still remains continuous. In this manner, the existing gas flow can be deflected particularly closely over a long effective distance past the guide surfaces of the liquid channel.

Preferably, the gas channel terminates in the flow space in a direction opposite the outlet opening, in which case the orifice is opposite the nozzle opening. In this manner, the gas flow is defined by the flow space in a direction that is counter the direction of the liquid flow when it leaves the outlet opening. Thus, the liquid is deflected in a particularly effective manner and distributed on the guide surface.

In a preferred embodiment the flow space tapers in the direction of the nozzle outlet. As a result of this, the flow rate of the gas increases, this promoting the liquid film formation and the discharge of the liquid from of the nozzle opening.

The nozzle opening that may also be referred to as the nozzle outlet, is preferably a slit or a gap. The nozzle outlet gap may be curved around the flow direction, for example curved in the form of a spiral.

In a preferred embodiment the nozzle body has essentially the form of a cylinder and comprises a gas connection to which the gas channel is fluidically connected, and comprises a liquid connection which is fluidically connected to the liquid channel. The gas connection and the liquid connection are preferably arranged together on a common first face side of the nozzle body. The nozzle outlet is preferably arranged on an oppositely located second face side of the nozzle body. In this manner, simple, clearly arranged and easy to handle forms of the nozzle body and, in particular, flow conditions in the nozzle body that are relatively easy for the gas are the result.

Preferably, the nozzle body with the gas channel and the liquid channel are produced in one piece, in particular by 3D printing. 3D printing or other additive manufacturing processes are particularly suitable for the production of the nozzle body.

According to another aspect of the invention, there is provided a nozzle device that comprises at least one of the pneumatic atomizing nozzles described hereinabove, in which case the nozzle device additionally comprises a fan that is disposed for supplying the pneumatic atomizing nozzle with gas. Preferably, the fan generates a pressure ratio from the gas pressure at the termination of the gas channel in the flow space to the pressure on the intake side of the fan of a maximum of 1.3. Preferably, the pressure at the termination of the gas channel in the flow space is increased relative to the pressure on the intake side by a maximum of 300 mbar.

According to yet another aspect of the invention, there is furthermore provided a method for operating a pneumatic atomizing nozzle, in particular a pneumatic atomizing nozzle exhibiting the features described hereinabove, said method comprising the following steps:

The pneumatic atomizing nozzle is supplied with liquid via a liquid channel. The liquid is ejected from the liquid channel into a flow space. The ejection is accomplished out of an outlet opening in a liquid discharge direction. Furthermore, gas is introduced into the flow space. In the flow space, a gas flow direction is defined, in particular due to the relative arrangement of gas inlet and nozzle opening. At the location where the liquid exits into the flow space at the outlet opening, the liquid is dispensed in a direction that is different from the gas flow direction. Preferably, the liquid discharge direction and the gas flow direction are opposed. The liquid entering into the flow space is charged with gas. By charging with gas, the liquid is deflected, and a liquid film is formed that flows in a flow direction to the nozzle outlet that is opposite the liquid discharge direction. The liquid is dispensed from the nozzle body through the nozzle outlet.

The gas is allowed to flow past the surface of the liquid film. Consequently, the liquid film is transported in the direction toward the gas outlet and, furthermore, can be excited to oscillate to form waves, which promotes the atomization outside the nozzle body.

Preferably, the ejection of the liquid out of the liquid channel into the flow space occurs through an outlet slit or outlet gap. Consequently, the ejection is linear and preferably opposite the gas flow. The linear ejection my occur along a curve along the periphery. Particularly preferably, the linear ejection occurs out of at least one gap or slit that is curved, serpentine or wound, and preferably spiraliform in some sections, said gap or slit being curved around the gas flow direction so that—even in the event of a minimal slit or gap width—there is provided an adequate outlet surface side for the liquid.

Preferably, the linear ejection of the liquid occurs on the face side of the guide body that contains the liquid channel.

During operation, an amount of liquid is supplied to the liquid channel so that the cross-section of the liquid channel is preferably completely filled with liquid. As a result of this, the liquid channel is also continuously cleaned and the danger that dirt particles will deposit on the channel walls is reduced.

In a particularly preferred embodiment, the gas is supplied with the aid of a fan whose outlet is connected—via a line—to the gas connection of the flow space.

Figure 2:
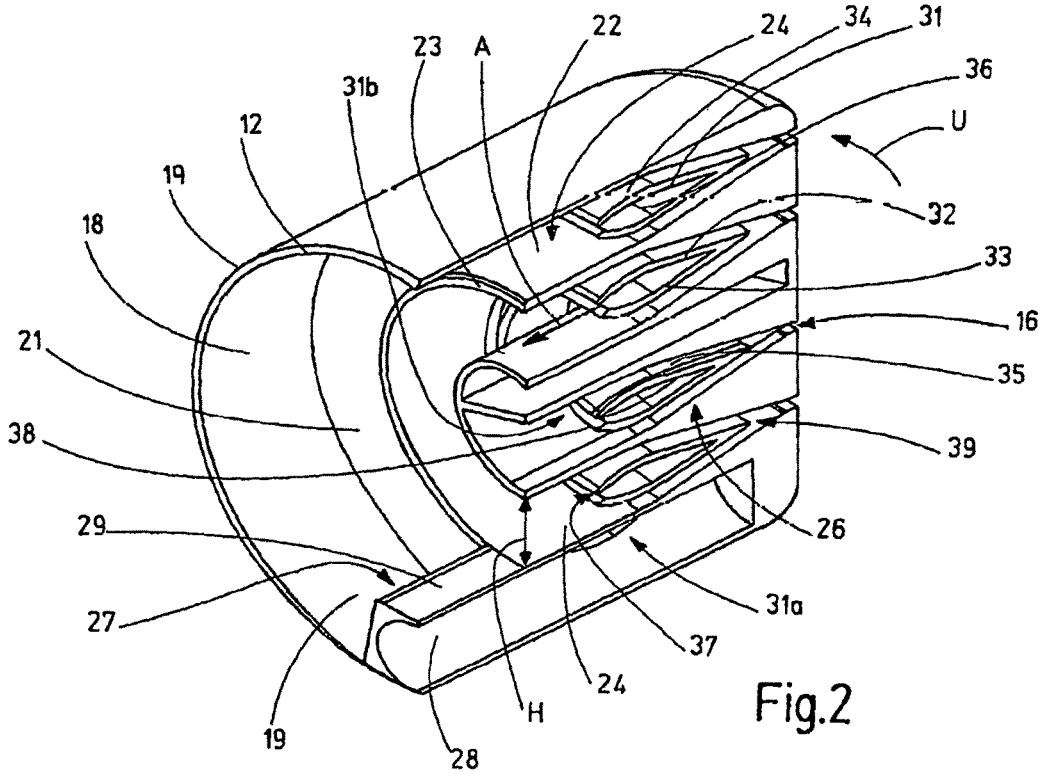
Figure 3:
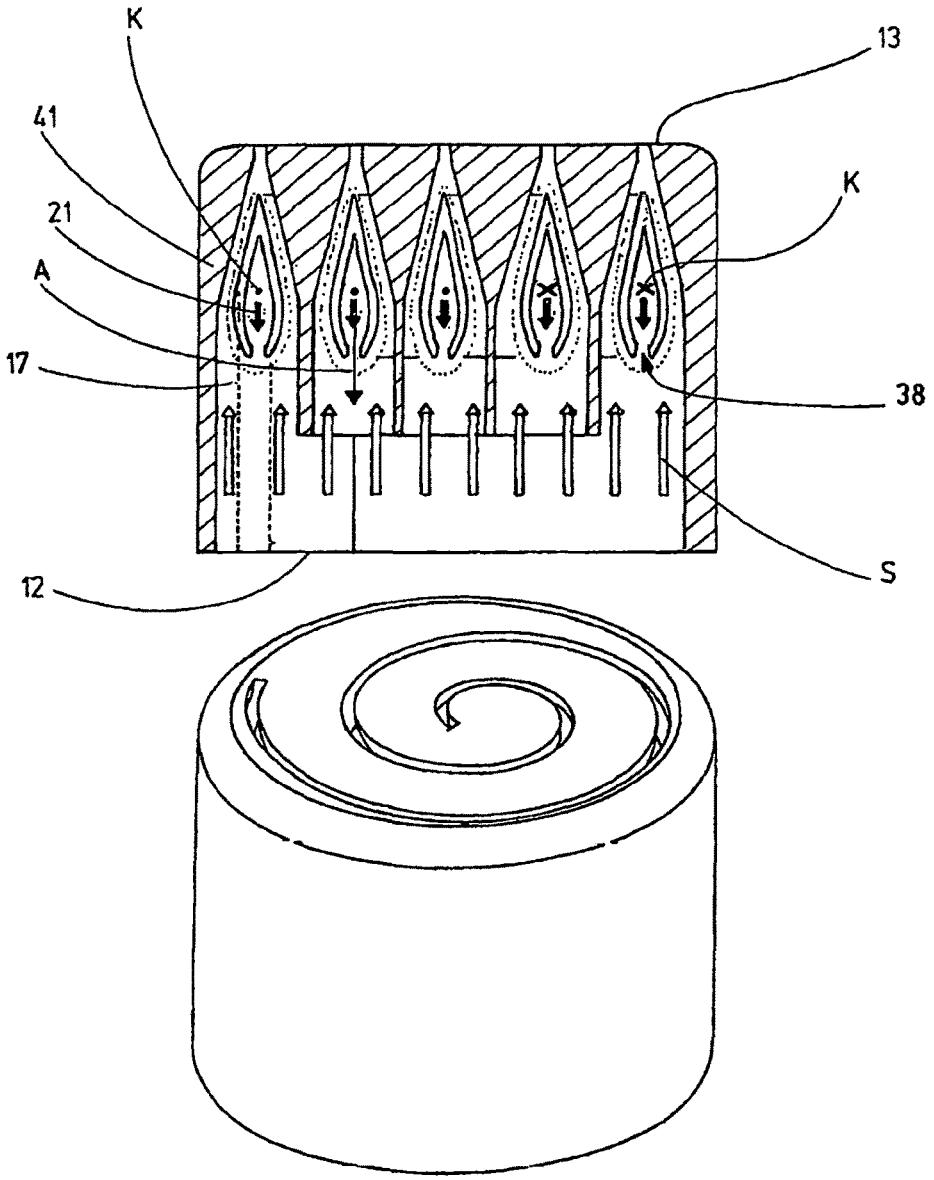
Figure 4:
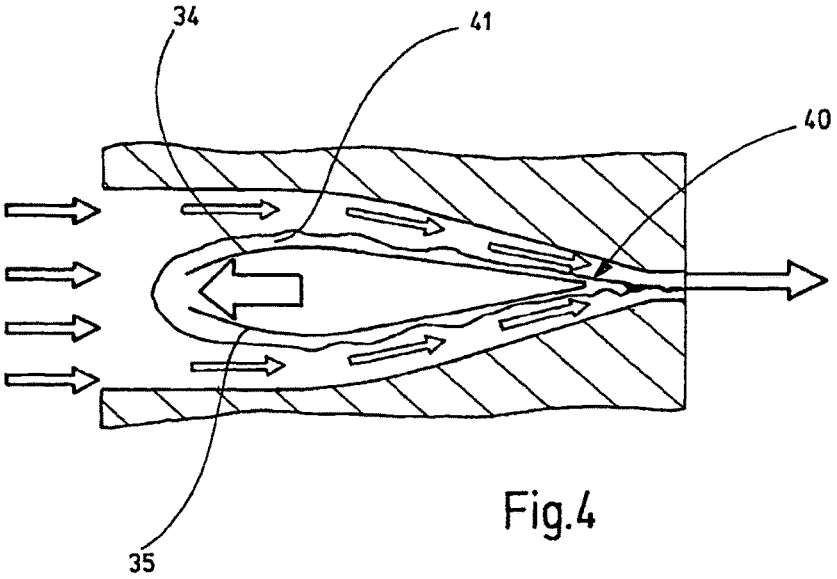
Figure 5:
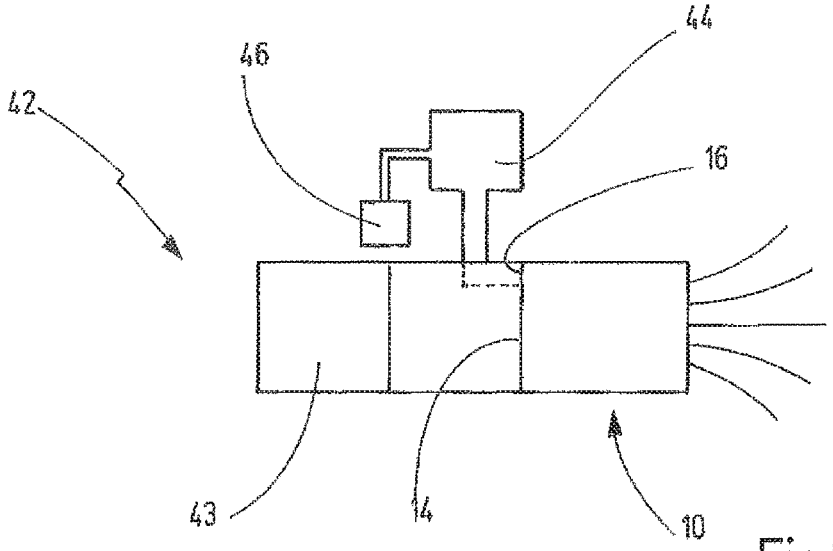
Figure 6:
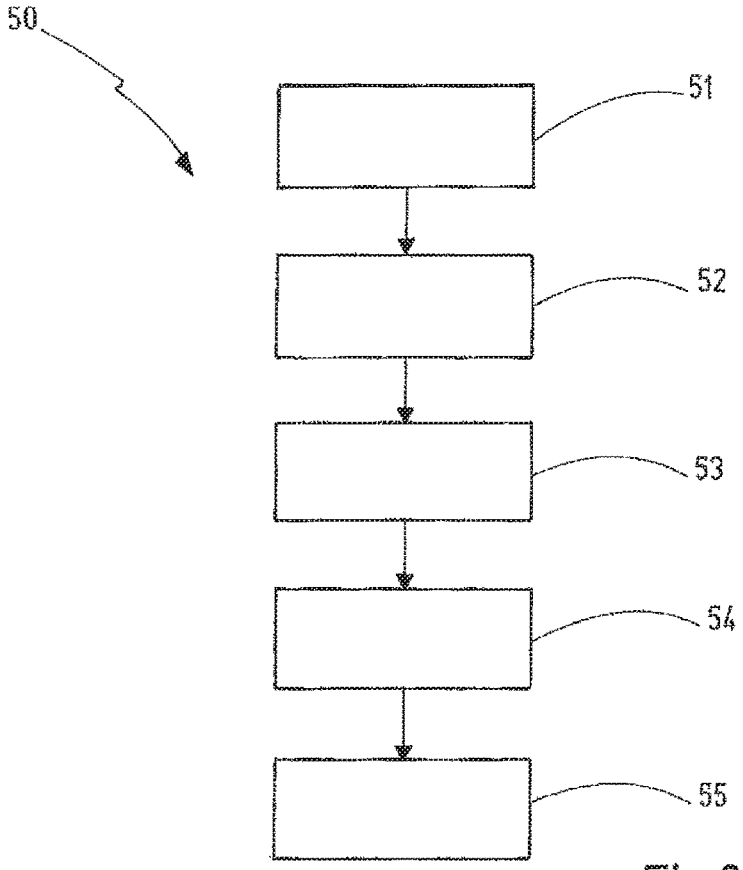

Additional details of advantageous embodiments of the invention can be inferred from the dependent claims, the figures, the drawings and the relevant description. The drawings show an embodiment of the invention solely for the purposes of illustration and not for narrowing the invention. They show in FIG. 1 a simplified perspective view of a pneumatic atomizing nozzle according to the invention;

FIG. 2 a perspective side view, as a simplified representation, of the pneumatic atomizing nozzle according to FIG. 1;

FIG. 3 a longitudinal view of the pneumatic atomizing nozzle according to FIGS. 1 and 2, in a perspective view and in longitudinal section;

FIG. 4 a detail of the longitudinal sectional view of FIG. 3;

FIG. 5 a schematized representation of a nozzle device comprising a pneumatic atomizing nozzle and a fan;

FIG. 6 a method for operating a pneumatic atomizing nozzle according to the invention in the form of a greatly simplified flow chart; and FIGS. 7*a*-7*f* plane views, in highly schematized diagrams, of exemplary configurations of the liquid channel and the outlet opening of a pneumatic atomizing nozzle according to various embodiments of the invention.

The pneumatic atomizing nozzle 10 shown in FIG. 1 comprises a nozzle body 11 that is essentially cylindrical. The nozzle body 11 has a first face side 12 and, preferably, a planar second face side 13. A gas connection 14 and a liquid connection 16 are arranged on the first face side 12 (see FIG. 5). A nozzle opening or a nozzle outlet 17 is arranged on the second face side 13 of the nozzle body 11. The nozzle outlet 17 is an outlet slit or an outlet gap that is wound around the cylinder axis Z by more than two complete revolutions to form a planar spiral.

FIG. 2 shows a longitudinal section through the nozzle body 11. Inside the nozzle body 11, a gas channel 18 adjoins the face side 12. The gas channel 18 is essentially cylindrical and is delimited by the cylindrical wall 19 of the nozzle body 11. The nozzle body 11 comprises a flow space 21 that is also delimited by the cylindrical wall 19 of the nozzle body 11. Inside the nozzle body 11, the gas channel 18 terminates axially in the flow space 21. A spiral wall 22 is arranged in the flow space 21. Due to the spiral wall 22, the flow space 21 is given the form of a spiral arm. The center axis Z of the spiral is parallel to or coincident with the cylinder axis Z.

With a planar, axially open inlet side 23, the flow space 21 adjoins the gas channel 18. The inlet side 23 of the flow space 21 forms an open face side that faces the face side 12 at which the gas channel 18 is connected to the gas connection 14. The flow space 21 is radially divided by the spiral wall 22, but is open in circumferential direction U, continuous and unbranched. The flow space 21 formed by a single spiral arm in FIG. 2 may also be formed by at least two spiral arms. Alternatively, the flow space 21 may, for example, have several spaces in the form of concentric cylindrical rings, said spaces comprising radial flow connections and dividing the gas flow in radial direction and in circumferential direction U.

The flow space 21 has a front section 24 and a rear section 26. The front section 24 borders the inlet side 23 and has a radial spiral arm height H that is constant along the cylinder axis Z. The rear section 26 adjoins the front section 24. In the rear section 26, the spiral arm height H decreases gradually in the direction toward the nozzle outlet 16. As a result of this, the flow space 21 tapers overall in radial direction. The spiraliform nozzle outlet slit 17 adjoins the rear section 26.

A liquid channel 27 is arranged in the flow space 21. The liquid channel 27 comprises a supply section 28 that is arranged on the wall 19 of the nozzle body 11. The supply section 28 extends parallel to the cylinder axis Z, beginning at the first face side 12 of the nozzle body 11. The supply section 28 has a supply channel wall 29. On the one hand, the spiral wall 22 branches off transversely with respect to the cylinder axis Z in circumferential direction U, and, on the other hand, an outlet section 31 of the liquid channel 27 branches off at a radial distance with respect to said spiral wall. Preferably, the outlet section 31 has only two mounting points, wherein a first mounting point 31*a* is located on the supply section 28 and a second mounting point 31*b* is located in the center of the nozzle body 11 and connected to the inner end of the spiral wall 22. Additional mounting points, in particular bars between the spiral wall 22 and outlet channel 31 may be omitted, so that an unimpaired flow of gas and liquid is made possible axially outside along the outlet section 31. The outlet section 31 extends axially from the front section 24 into the rear section 26.

The outlet section 31 extends through the flow space 21 along the periphery of the nozzle body 11, so that a section of the liquid channel 27 is enclosed by the flow space 21. The outlet section 31 has a first channel wall 32 and a second channel wall 33. The first channel wall 32 has a first wall outside surface 34, and the second channel wall 33 has a second wall outside surface 35, each—viewed along the cylinder axis Z—being spiraliform, so that the outlet section 31 has the form of a planar spiral.

The outlet section 31 has an outlet side 37. The first channel wall 32 and the second channel wall 33 are not connected on the outlet side 37, so that—radially between the first channel wall 32 and the second channel wall 33—a gap-shaped, continuous outlet opening 38 is formed, said opening following the course of the outlet section 31. The outlet opening 38 is arranged at a distance from the inlet side 23 of the flow space 21 and faces said inlet side. The outlet opening 38 is planar and oriented transversely with respect to the gas flow direction S. Here, the outlet opening 38 has in particular the form of a planar spiral that, however, may also be configured as a three-dimensional spiral, i.e., a screw. Due to the spiral form, the outlet opening 38 extends along the periphery of the flow space 21. In particular, the outlet opening 38 extends in an arcuate manner along the spiral wall 22 and the wall 19 of the nozzle body 11. Furthermore, due to the spiral form, the outlet opening 37 extends in an arcuate manner along the periphery of the flow space 21 on a path with continuously decreasing diameter.

The side of the outlet section 31 opposite the outlet side 37 forms a stripping side 39. The outlet section 31 tapers axially in the form of a wedge toward the stripping side 39 and the nozzle opening 17, respectively, and is arranged in the rear section 26 of the flow space 21 that tapers in the direction toward the nozzle opening 17 in the form of a wedge. The first wall outside surface 34 and the second wall outside surface 35 extend from the outlet side 37 to the stripping side 39. The first wall outside surface 34 is oriented radially outward, and the second wall outside surface 35 is oriented radially inward. The first channel wall 32 and the second channel wall 33 are connected to each other on the stripping side 39 and form a tearing edge 40 for a liquid film 41 there, said liquid film flowing along the channel walls 32, 33. The stripping side 39 or tearing edge is arranged at a distance near the nozzle outlet 17.

Viewed in longitudinal section, as is obvious from FIG. 2, the channel walls 32, 33 together thus form an essentially symmetrical wedge configuration or elongated drop configuration similar to an airfoil profile, relative to the longitudinal plane and plane of symmetry parallel to the cylinder axis Z.

FIG. 3 is a longitudinal section through the pneumatic atomizing nozzle 10 as described hereinabove. Due to its orientation in the flow space 21, the outlet opening 38—together with the first channel wall 32 and the second channel wall 33—defines an outlet direction A for the liquid on the inlet side 23. This is oriented in opposite direction of the flow direction S of the gas that flows from the first face side 12 to the second face side 13.

The pneumatic atomizing nozzle 10 described so far and comprising the nozzle body 11, the gas channel 18 and the liquid channel 27 is preferably configured as a one-piece integral body and can thus be produced, for example, by an additive manufacturing process, in particular, by 3D printing. Preferably, the nozzle body 11 is free of seams and joints and consists of a uniform material, preferably plastic or metal. Indeed, it is also possible to produce the nozzle body 11 with several separately manufactured and joined parts; however this is less desirable in this case—among other things due to the greater expense and the disadvantages related to seams and joints.

The pneumatic atomizing nozzle 10 described hereinabove can be used in many applications such as, e.g., for moistening or cooling objects in industrial production, for atomizing water and the like. In particular, it is suitable for use in dust precipitation systems or gas cooling systems. The pneumatic atomizing nozzle 10 is operated as described hereinafter, in which case the description relates to FIGS. 1-5:

The pneumatic atomizing nozzle 10 is charged with gas, for example air, that is moved in the direction of flow by a fan. As illustrated by FIG. 5 showing an embodiment of an inventive nozzle device 42 in a simplified block diagram; it comprises a pneumatic atomizing nozzle 10 and a fan 43, and, to do so, the fan 43 is connected to the gas connection 14 that terminates on the face side 12 in the gas channel 18 of the pneumatic atomizing nozzle 10. Due to the relative arrangement of the gas connection 14 on the face side 12, the gas channel 18, as well as the flow space 21 and the nozzle outlet 16 on the opposite face side 13, a gas flow direction S is defined in the flow space 21.

A pump 44 is connected to the liquid connection 16 on the first face side 12 of the nozzle body 11, in which case the liquid connection 16 is connected to the supply section 28 of the liquid channel 27. The pump 44 conveys water out of a liquid supply 46, so that the pneumatic atomizing nozzle 10 is supplied with liquid, for example water. The inner flow dimensions inside the nozzle body 11, in particular the spiral arm height H, the cross-sectional area of the liquid channel, the width of the outlet gap 38 as defined by the radial distance of the channel walls 32, 33 from each other, or the height of the nozzle outlet 17, etc., are adequately dimensioned, preferably are at least 2 mm, so that water loaded with contaminants can also be used for supplying the pneumatic atomizing nozzle 10, without there being a noticeable risk of plugging the pneumatic atomizing nozzle 10.

Initially, the liquid flows along the supply section 28 into the outlet section 31. Within the outlet section 31, the liquid flows along the circumferential direction U, transversely with respect to the cylinder axis Z around the gas flow S. The outlet section 31 thus defines a channel direction K in which the liquid flows in the outlet section 31 and which is oriented transversely with respect to the gas flow direction S. This is indicated in FIG. 3 by the symbols "•" and "x" that symbolize a flow out of the plane of projection or into the plane of projection.

On the outlet side 37 of the outlet section 31, the liquid is linearly ejected through the gap-shaped outlet opening 38 in front section 24 of the flow space 17 in outlet direction A. Due to the arrangement of the outlet opening 38 relative to the first face side 12 where the gas channel 18 terminates in the flow space 21, the outlet direction A of the gas flow direction S is in the opposite direction.

As is shown specifically in the detail of FIG. 4, the liquid flowing out of the outlet opening 38 is caught by the oppositely directed gas flow S and deflected by 180° into the gas flow directions. Due to the gas flow, the liquid is bilaterally distributed around the outlet section 31 to the first wall outside surface 34 and the second wall outside surface 35 of the channel walls 32, 33 while forming a liquid film 41. The wall outside surfaces 34, 35 form the guide surfaces for the liquid film 41. To this extent, the channel walls 32, 33 form a guide body 36 for the liquid, said guide body extending along the periphery of the nozzle body 11. The guide body 36 divides the flow space 21 and the liquid flow outside the liquid channel 27 in radial direction, so that the liquid flows bilaterally around over the upper, first wall outside surface 34 and the lower, second wall outside surface 35 in the Figures. Due to the opposing gas flow that is largely uniform in radial direction and the essentially symmetrical guide body 36, the liquid flow is divided largely uniformly outside the liquid channel 27. The gas flowing on the liquid surface to the nozzle outlet 17 then drives the liquid film 41 in the gas flow direction S toward the nozzle outlet 17. In doing so, the liquid film 41 is also charged with the gas in such a manner that the liquid film 41 is additionally excited to oscillate. In doing so, a preliminary atomization of the liquid film 41 may already occur, while these—together with the partial gas streams—flow over the wall outside surfaces 34, 35 on the guide body 36 to the stripping side 39.

Inasmuch as the width of the flow space 21—measured between the wall outside surfaces 34, 35 of the guide body 36 and the oppositely located inside surfaces of the spiral wall 22—increasingly decrease toward the stripping side, the partial liquid flows 41 flowing over the wall outside surfaces 34, 35 become increasingly thinner and are accelerated. On the stripping side, the partial liquid flows 41 meet at the tearing edge 40 and are separated from the guide body 36 by the latter. The liquid flows are ejected together with the gas flow toward the outside through the nozzle outlet opening 17 out of the pneumatic atomizing nozzle 10, in which case the liquid is atomized—as it is being discharged—into fine liquid droplets outside the pneumatic atomizing nozzle 10.

Now reference is made to FIG. 6 that shows a flowchart illustrating a general method 50 for operating a pneumatic atomizing nozzle according to the invention that can be used, in particular, with the pneumatic atomizing nozzle 10 according to FIGS. 1-5.

The method 50 begins with the supply of liquid to a pneumatic atomizing nozzle, e.g., the pneumatic atomizing nozzle 10, through a liquid channel (e.g., 27), as illustrated by step 51.

Then the liquid flows through the liquid channels and is ejected therefrom into a flow space (e.g., 17) in a liquid outlet direction A, as illustrated by step 52.

At the same time, gas is introduced into the flow space in a gas flow direction S (step 53). The gas flow direction S is different from the liquid outlet direction A and is preferably opposite thereto.

The liquid entering the flow space is charged with the gas flow in such a manner that the liquid is deflected and a liquid film (e.g., 41) is formed, said liquid film flowing in a flow direction S to a nozzle outlet (e.g., 17) counter the liquid outlet direction A (step 54). Due to the gas flow, it is possible to pre-atomize the liquid film already up to a certain degree.

Finally, the liquid is dispensed through the pneumatic atomizing nozzle outward through the nozzle outlet. In doing so, the liquid is torn apart and finely atomized due to the flowing gas. The discharge may be accomplished in that the ejected liquid slightly spreads toward the outside in the form of a truncated cone, which further supports atomization.

In a preferred embodiment of the method 50 according to the invention, the supply of the gas into flow space occurs with a fan (e.g., 43). The use of expensive compressors is not necessary.

In another advantageous embodiment of the method 50, the ejection of the liquid out of the liquid channel into the flow space in a linear manner through a narrow outlet gap occurs preferably through a tightly wound spiraliform outlet gap. The outlet gap may—at least in some sections—also be curved, wound or serpentine. In any event, the longest possible outlet gap is formed as a result of this, and the liquid being discharged through the outlet gap can be effectively charged and be deflected as desired and/or re-shaped to form a thin liquid film, as a result of which atomization is advantageously further supported.

Numerous modifications are possible within the framework of the invention. For example, FIGS. 7*a*-7*f* show exemplary courses of liquid channels 27 with associate outlet openings 38 according to different embodiments of the invention. Shown are planar views that result by projecting the liquid channels 27 and the outlet openings 38 on a plane of projection that extends transversely through the flow space 21 and essentially perpendicularly to the outlet direction A (see FIG. 2) of the liquid out of the outlet opening 38. Although the limited width of the gap-shaped outlet openings 38 results in band-shaped curve courses when projected onto the plane of projection, these are shown here by thin lines for simple and clear illustration.

Figure 7A:
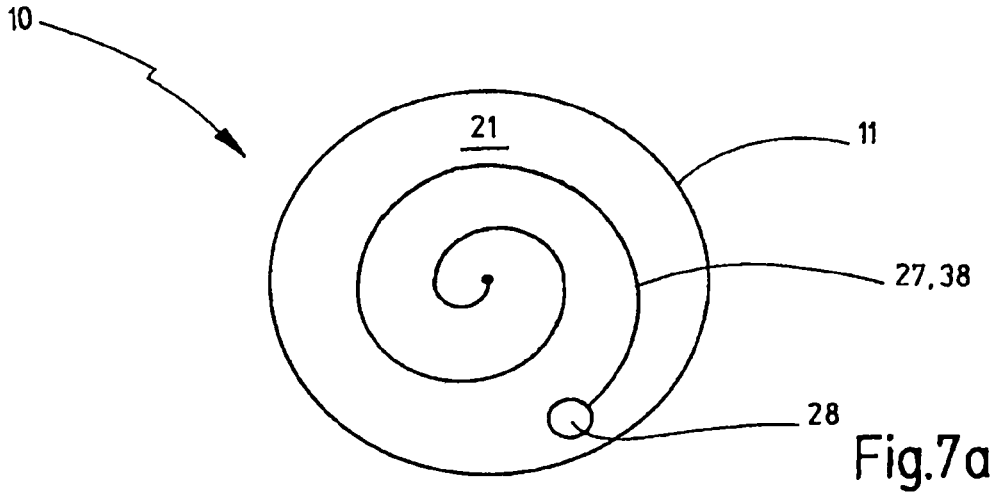

FIG. 7*a* shows the line of projection of the spiraliform liquid channel 27 with the outlet opening 38 of the preferred embodiment shown by FIGS. 1 to 3. The spiral form can result from a planar spiraliform or helical course of the liquid channel 27.

Instead of the spiral form the course of the liquid channel 27 with the outlet opening 38 could also take the form of a circle or of several concentric circles that are preferably continuously connected to each other, however need not be. Depending on the application, a curved arcuate section, e.g., of a circle or a spiral, that preferably subtends an angle of at least 90°, more preferably 180°, may be adequate. Particularly advantageous is an extension over at least one revolution (by at least 360°) or even over two revolutions.

Figure 7B:
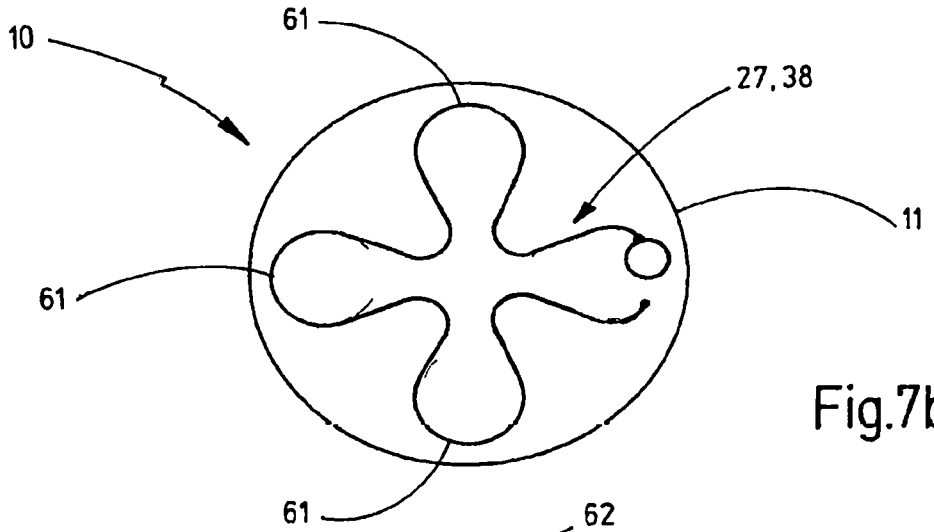

FIG. 7*b* shows a serpentine or wound, meandering form of the course of a liquid channel 27 with the outlet opening 38 that has several—in this instance four—loops 61 that are turned by an angle of 90°, here around a central center axis of the flow space and connected to each other.

Figure 7C:
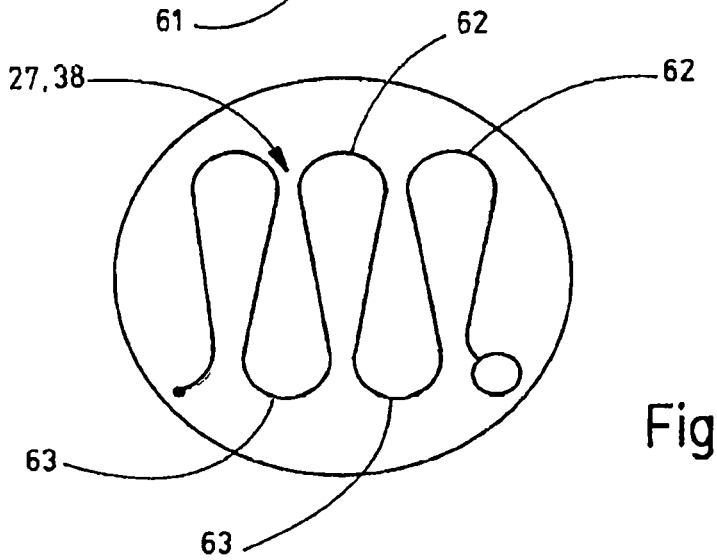

The meandering embodiment according to FIG. 7*c* is similar to that of FIG. 7*b*, whereby here several loops 62, 63 are formed, said loops being arranged next to each other in a direction transverse to the flow space 21 and connected to each other.

Figure 7D:
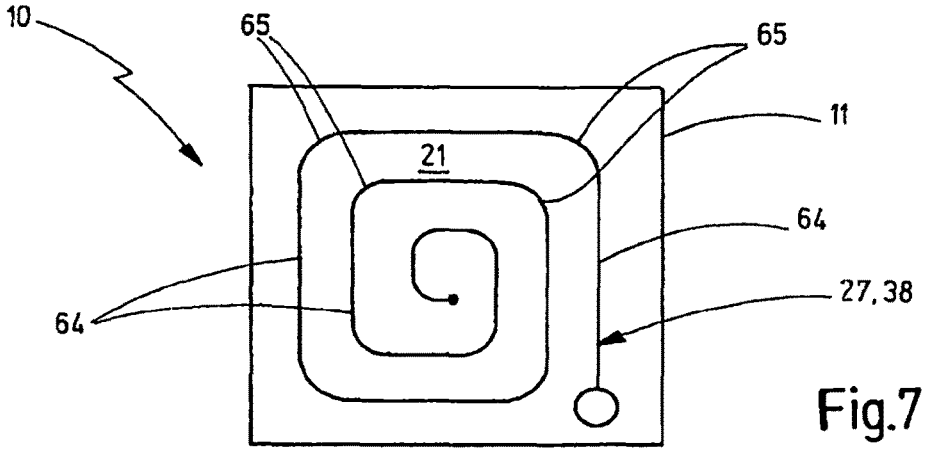
Figure 7E:
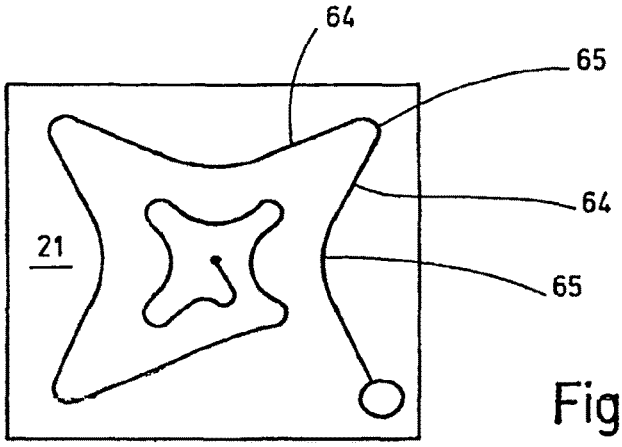
Figure 7F:
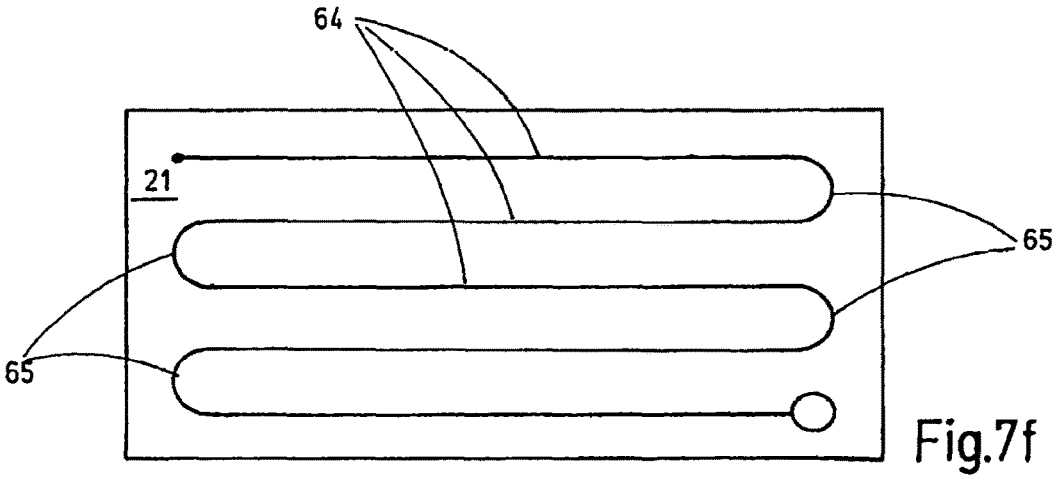

Furthermore, FIGS. 7*d*-7*f* show embodiments, wherein the spiraliform, steliform or serpentine courses of the liquid channels 27 and the outlets 38 each have several straight line sections 64 with interposed curved or arcuate connecting sections 65. As in the embodiments mentioned hereinabove, the courses may be two-dimensional or three-dimensional.

Advantageously in all embodiments, an elongated, continuous, kink-free course with a plane of projection is obtained that extends along or covers a large portion of the flow space 17 or the plane of projection. The great length of the liquid channel 27 and the outlet openings 38 allows—even with a highly limited gap width—an adequate amount of liquid to discharge in the form of an elongated, uniform, thin liquid film out of the outlet opening to be subsequently effectively atomized.

The nozzle opening 17 forming the outlet of the nozzle 10 preferably has essentially the same form as the line of projection of the liquid channel 27 and the outlet opening 38, however, it may also be different therefrom.

Furthermore, as is also obvious from FIGS. 7*a*-7*f*, the flow space 21 may have any desired form—preferably cylindrical or tubular—with, for example, a circular, oval, square, rectangular or any other suitable cross-section.

Disclosed herein is a pneumatic atomizing nozzle 10, which preferably can be supplied with gas and operated by means of a fan 43. The pneumatic atomizing nozzle 10 has a nozzle body 11, which bounds a flow space 21. The pneumatic atomizing nozzle 10 also has a liquid channel 27 having an outlet opening 38. Within the flow space 21, a liquid film 41 is formed, which is transported within the flow space 21 to the nozzle outlet 17 by the gas flow. The outlet opening 38 of the liquid channel 27 defines an outlet direction A for the liquid into the flow space 21, which outlet direction preferably is opposite the flow direction S of the liquid film 41. At least in some sections, the liquid channel 27 and the outlet opening 38 thereof preferably extend transversely through the nozzle body 11 in a curved, wound, or meandering manner.

List of Reference Signs:

| | |
|---|---|
| 10 | Atomizing nozzle |
| 11 | Nozzle body |
| 12 | First face side |
| 13 | Second face side |
| 14 | Gas connection |
| 16 | Liquid connection |
| 17 | Nozzle outlet, nozzle orifice |
| 18 | Gas channel |
| 19 | Wall |
| 21 | Flow space |
| 22 | Spiral wall |
| 23 | Inlet side |
| 24 | Front section |
| 26 | Rear section |
| 27 | Liquid channel |
| 28 | Supply section |
| 29 | Supply channel wall |
| 31 | Outlet section |

-continued

| List of Reference Signs: | |
|---|---|
| 31a | First mounting point |
| 31b | Second mounting point |
| 32 | First channel wall |
| 33 | Second channel wall |
| 34 | First wall outside surface |
| 35 | Second wall outside surface |
| 36 | Guide body |
| 37 | Outlet side |
| 38 | Outlet opening |
| 39 | Stripping side |
| 40 | Tearing edge |
| 41 | Liquid film |
| 42 | Nozzle device |
| 43 | Fan |
| 44 | Pump |
| 46 | Water source, liquid supply |
| 50 | Method |
| 51-55 | Method steps |
| 61-63 | Loops |
| 64 | Straight line sections |
| 65 | Connecting sections |
| Z | Cylinder axis |
| U | Circumferential direction |
| H | Spiral arm height |
| A | Outlet direction |
| S | Flow direction |
| K | Channel direction |

The invention claimed is:

1. A pneumatic atomizing nozzle (10) comprising a nozzle body (11) that defines a flow space (21) which leads to a nozzle opening (17) which defines a nozzle outlet;

a gas channel (14) for supplying a gas, said gas channel (14) terminating in the flow space (21);

a liquid channel (27) for supplying a liquid, said liquid channel (27) having at least one outlet opening (38) through which the liquid is discharged into the flow space (21) in order to be charged with gas from the gas channel (14) and form a liquid film (41) in a flow direction (S) in the flow space (21); and said at least one outlet opening (38) defining an outlet direction (A) out of the liquid channel (27) for the liquid, said outlet direction (A) being opposite to the flow direction (S) of the liquid film (41) in the flow space (21);

said liquid channel (27) being formed through a guide body (36) that is configured and arranged so as to divide a liquid flow in the flow space (21) and to guide liquid flowing to the nozzle opening (17), said guide body (36) having the form, at least in some section, of one of an airfoil shape or an elongated drop shape or symmetrical wedge shaping in cross-section, and a front side of the guide body (36) facing the nozzle opening (17) forming a tearing edge (40) for the liquid film (41) arranged near the nozzle opening (17).

2. The pneumatic atomizing nozzle (10) of claim 1, in which liquid channel (27) and the at least one outlet opening (38) of the liquid channel (27) extend in a manner such that when they project onto a plane that extends transversely through the flow space (21) and perpendicularly to the outlet direction (A), a line is formed that is curved, wound or meandering, at least in some sections.

3. The pneumatic atomizing nozzle (10) of claim 1 in which the liquid channel (27) is arranged inside at least a section of the flow space (21).

4. The pneumatic atomizing nozzle (10) of claim 1 in which the liquid channel (27) extends in an arcuate manner around the flow direction (S) of the liquid film.

5. The pneumatic atomizing nozzle (10) of claim 1 in which the outlet opening (38) is an outlet slit or gap (38).

6. The pneumatic atomizing nozzle (10) of claim 5 in which the outlet slit or gap (38) is arcuate in at least some sections.

7. The pneumatic atomizing nozzle (10) of claim 1 in which the gas channel (14) terminates in the flow space (21) opposite the outlet opening (38).

8. The pneumatic atomizing nozzle (10) of claim 1 in which the flow space (21) tapers in the direction of a nozzle outlet (17) of the nozzle body (11).

9. The pneumatic atomizing nozzle (10) of claim 1 in which the nozzle body (11) has a nozzle outlet (17) that is curved around the flow direction (S).

10. The pneumatic atomizing nozzle (10) of claim 1 in which the nozzle body (11) has a cylindrical form and comprises a gas connection that is fluidically connected to the gas channel (14) and a liquid connection that is fluidically connected to the liquid channel (27), said gas connection and liquid connections being arranged together on a common face side (12) of the nozzle body (11), and the nozzle body (11) has a nozzle outlet arranged on an opposite face side (13) of the nozzle body (11).

11. The pneumatic atomizing nozzle (10) of claim 1 in which the nozzle body (11) is made in one piece with the gas channel (14) and the liquid channel (27) formed by 3D printing.

12. The pneumatic atomizing nozzle (10) of claim 1 including a fan (43) which is arranged for supplying the pneumatic atomizing nozzle (10) with gas.

13. A method (50) for operating a pneumatic atomizing nozzle comprising the steps:

supplying (51) liquid to a liquid channel (27) that is formed through a guide body (36) which is configured and arranged so as to divide a liquid flow in a flow space (21) and to guide liquid flowing to a nozzle opening (17), wherein the guide body (36) has the form, at least in some section, of one of an airfoil shape or an elongated drop shape or symmetrical wedge shape in cross-section, wherein a front side of the guide body (36) facing the nozzle opening (17) forms a tearing edge (40) for a liquid film (41) near the nozzle opening (17);

ejecting (52) the liquid from the liquid channel (27) into the flow space (21) in a liquid outlet direction (A);

supplying (53) gas to the flow space (21) for which a gas flow direction (S) has been defined, said gas flow direction being different from the liquid outlet direction (A);

charging (54) the liquid entering the flow space (21) with the gas in such a manner that the liquid is deflected around the guide body (36) and the liquid film (41) is formed, said liquid film flowing in a flow direction (S) opposite the liquid outlet direction (A) to the nozzle opening (17); and dispensing (55) the liquid through the nozzle opening (17).

14. The method (50) of claim 13, wherein supplying the gas to the flow space (21) is done using a fan (43).

15. A pneumatic atomizing nozzle (10) comprising a nozzle body (11) that defines a flow space (21);

a gas channel (14) for supplying a gas, said gas channel (14) terminating in the flow space (21);

a liquid channel (27) for supplying a liquid, said liquid channel (27) having a spiraliform around the flow direction of the liquid film, said liquid channel (27) having at least one outlet opening (38) through which the liquid is discharged into the flow space (21) in order to be charged with gas from the gas channel (14) and form a liquid film (41) in a flow direction (S) in the flow space (21); and said at least one outlet opening (38) defining an outlet direction (A) out of the liquid channel (27) for the liquid; said outlet direction (A) being opposite to the flow direction (S) of the liquid film (41) in the flow space (21).

16. A method (50) for operating a pneumatic atomizing nozzle comprising the steps:

supplying (51) liquid to a liquid channel (27);

ejecting (52) the liquid from the liquid channel (27) into a flow space (21) in a liquid outlet direction (A) linearly through an outlet gap (38) that is curved in a spiraliform manner;

supplying (53) gas to a flow space (21) for which a gas flow direction (S) has been defined, said gas flow direction being different from the liquid outlet direction (A);

charging (54) the liquid entering the flow space (21) with the gas in such a manner that the liquid deflected and a liquid film (41) is formed, said liquid film flowing in a flow direction (S) opposite the liquid outlet direction (A) to a nozzle outlet (17); and dispensing (55) the liquid through the nozzle outlet (17).

17. The pneumatic atomizing nozzle (10) of claim 15 in which the spiral form of the liquid channel (27) extends at least over one revolution.

* * * * *